US005565740A

United States Patent [19]

Hiramatsu et al.

[11] Patent Number: 5,565,740

[45] Date of Patent: Oct. 15, 1996

[54] ELECTRONIC BALLAST FOR HOT CATHODE DISCHARGE LAMPS

[75] Inventors: Akinori Hiramatsu, Ikoma; Hiroyuki Sako, Hirakata; Kazuhiro Gotoh, Hirakata; Nobukazu Miki, Hirakata, all of Japan

[73] Assignee: Matsushita Electric Works, Ltd., Kodama, Japan

[21] Appl. No.: 517,302

[22] Filed: Aug. 21, 1995

Related U.S. Application Data

[63] Continuation of Ser. No. 105,539, Aug. 12, 1993.

[30] Foreign Application Priority Data

Jan. 14, 1993 [JP] Japan ..... 5-004557

[51] Int. Cl.[6] ..... H05B 37/02

[52] U.S. Cl. ..... 315/209 R; 315/238; 315/307; 315/DIG. 7

[58] Field of Search ..... 315/105, 209 R, 315/238, 307, DIG. 7

[56] References Cited

U.S. PATENT DOCUMENTS

| | | | |
|---|---|---|---|
| 4,564,897 | 1/1986 | Okamoto et al. | 363/132 |
| 4,933,831 | 6/1990 | Takahashi et al. | 363/132 |
| 4,935,669 | 6/1990 | Nilssen | 315/205 |
| 4,959,591 | 7/1990 | Hirschmann . | |
| 5,063,490 | 11/1991 | Maehara et al. | 315/247 |
| 5,144,195 | 9/1992 | Konopka et al. . | |
| 5,177,408 | 1/1993 | Marques . | |

*Primary Examiner*—Robert Pascal
*Assistant Examiner*—Darius Gambino
*Attorney, Agent, or Firm*—Kenyon & Kenyon

[57] ABSTRACT

An electronic ballast for hot cathode discharge lamp comprises a DC voltage source, a chopper, and an inverter. The chopper includes a switching element connected in series with an inductor across the DC voltage and driven to turn on and off for providing a periodically interrupted voltage which is smoothed by a capacitor to produce a smoothed DC voltage as a chopper output. The inverter includes at least one switching element which is coupled to the chopper output to produce therefrom a high frequency AC voltage as an inverter output to be applied to cathodes of the discharge lamp for lighting the discharge lamp. The ballast is characterized to include an inverter controller and a delay circuit. The inverter controller controls the inverter to operate selectively in a normal mode of providing the inverter output of a first level and in a limited mode of providing the inverter output of a second level which is lower than the first level and is determined to give a preheating current to the cathodes. The delay circuit delays the start-up of the inverter for a time period from the start-up of the chopper. The inverter controller controls the inverter to operate in the limited mode after the start-up of the inverter for a predetermined period for preheating the discharge lamp after which the inverter controller allows the inverter to operate in the normal operation mode for lighting the discharge lamp.

14 Claims, 10 Drawing Sheets

CHOPPER START-UP
STEADY STATE LEVEL
CHOPPER OUTPUT
E0
0
tx
T

V2
CAPACITOR 152 VOLTAGE
VTH
0
T
LOW AMBIENT TEMPERATURE

INVERTER OUTPUT
TF
0
t0
t1
PREHEATING
t2
LIGHTING

V2
CAPACITOR 152 VOLTAGE
VTH
0
HIGH AMBIENT TEMPERATURE

INVERTER OUTPUT
TF
0
t0
PREHEATING
LIGHTING
t1'
t2

ELECTRONIC BALLAST FOR HOT CATHODE DISCHARGE LAMPS

RELATED PATENT APPLICATIONS

This is a continuation of U.S. patent application Ser. No. 08/105,539, filed Aug. 12, 1993.

BACKGROUND OF THE INVENTION

1. Field of the Invention

The present invention is directed to an electronic ballast for hot cathode discharge lamp having filaments of the type which requires preheating at the start of lighting, and more particularly to the electronic ballast including a chopper and inverter combination for producing a driving voltage to the discharge lamp from a DC power source.

2. Description of the Prior Art

Electronic ballast are widely utilized for driving discharge lamps such as fluorescent lamps. As disclosed in U.S. Pat. Nos. 5,144,195, 4,959,591, and 5,177,408, the electronic ballast is designed generally to comprises a chopper providing from a DC voltage supply a smoothed step-up output from a DC supply and an inverter which is energized by the chopper output to provide a high frequency AC voltage to be applied to the discharge lamp for lighting thereof.

U.S. Pat. No. 5,144,195 discloses a ballast circuit in which the chopper is controlled to start operating in a delayed manner from the start-up of the inverter so that the inverter starts operating in a initial transient period immediately after the energization of the ballast circuit while the chopper is not active enough to provide substantially a steady-state chopper output.

U.S. Pat. No. 4,959,591 discloses a ballast circuit in which the chopper and the inverter are caused to start operating simultaneously after the energization of the ballast circuit such that the inverter output becomes stable after an initial transient period in which the chopper increases its output toward a steady state level.

In the ballast circuits of the above two patents, the inverter acts in the transient period to produce a limited output which may be utilized to preheating the discharge lamp of hot cathode type. However, the inverter suffers at the start of its operation from unstable input voltage and therefore is very likely to cause uncontrolled conditions resulting in abnormal oscillation of the inverter output, excessive noises, or undue stress applied to switching elements in the inverter, all of which should be avoided for safe and reliable ballast operation. Particularly, since the ballast circuits include no positive scheme of controlling the inverter to limit its output during the transient period, the inverter is subject directly to unstable voltage from the chopper during that period and is therefore very likely to cause unexpected and undesired oscillation.

U.S. Pat. No. 5,177,408 disclose a ballast for instant-start lamp, i.e., cold cathode discharge lamp. Although the ballast of the patent is designed to permit the inverter to start operating only after the chopper becomes stable to provide a steady state voltage to eliminate the above problems, the inverter acts to produce its full voltage upon being started and is not controlled to produce a limited voltage as is required for preheating the hot cathode discharge lamp.

SUMMARY OF THE INVENTION

In view of the above problems and requirements, the present invention has been achieved to present an electronic ballast for a hot cathode discharge lamp. The ballast of the present invention comprises a DC voltage source, a chopper, and an inverter. The chopper includes a switching element which is connected in series with an inductor across the DC voltage and which is driven to turn on and off for providing a periodically interrupted voltage which is smoothed by a capacitor to produce a smoothed DC voltage as a chopper output. The inverter includes at least one switching element which is coupled to the chopper output to produce therefrom a high frequency AC voltage as an inverter output to be applied to cathodes of the discharge lamp for lighting the hot cathode discharge lamp. The electronic ballast of the present invention is characterized to include an inverter controller and a delay circuit. The inverter controller is designed to control the inverter to operate selectively in a normal mode of providing said inverter output of a first level and in a limited mode of providing said inverter output of a second level which is lower than said first level and is determined to give a preheating current to said cathodes. The delay circuit is included to delay the start-up of the inverter from the start-up of the chopper in such a manner as to enable the inverter to operate only after the chopper output increases to a predetermined level. The inverter controller controls the inverter to operate in the limited mode after the start-up of the inverter for a predetermined period for preheating the discharge lamp after which the inverter controller allows the inverter to operate in the normal operation mode for lighting the discharge lamp. With the provision of thus designed inverter controller and the delay circuit, it is possible to preheat the hot cathode type discharge lamp in a controlled manner after the start-up of the chopper and in advance of applying the full inverter output voltage to the discharge lamp for assuring a reliable circuit operation and prolong a lamp life, while protecting the inverter from causing undesirable and unexpected oscillation.

Accordingly, it is a primary object of the present invention to provide an improved electronic ballast which is capable of preheating the hot cathode type discharge lamp effectively prior to applying the full inverter output voltage thereto for assuring improved and effective circuit operation of driving the discharge lamp.

In a preferred embodiment, the inverter comprises a resonant circuit which provides a resonance voltage as the inverter output to the discharge lamp. The switching circuit of the inverter is enabled to vary a frequency of the inverter output over a range including a resonance frequency of the resonant circuit. The inverter controller operates in the operation mode for producing the inverter output of a first frequency around the resonance frequency and operating in the limited operation mode for producing the inverter output of a second frequency higher than the first frequency.

It is therefore another object of the present invention to provide an improved electronic ballast in which the inverter controller controls to vary the frequency of the inverter for differentiating the inverter output between the limited and normal operation modes in order to effect desired preheating of the discharge lamp before lighting thereof.

The delay circuit is preferred to provide a start-up signal for initiating the limited operation mode at a timing dependent upon an ambient temperature such that the limited operation mode is initiated earlier as the ambient temperature becomes higher. This is consistent with the lamp characteristics and enables to accelerate the lighting of the discharge lamp as the environment temperature of the lamp becomes higher, which is therefore a further object of the present invention.

Preferably, the inverter controller includes a voltage detector for the chopper output and includes a timer which counts a predetermined time period after the chopper output is detected by the voltage detector to increase to a predetermined level. At the end of the time period, the timer issues a stop signal to switch the inverter controller for operating the inverter in from the limited mode to the normal mode.

Further, the delay circuit is designed alternately to comprise a voltage detector for the chopper output and provides a pre-heating start signal when the chopper output reaches a predetermined level selected to be lower than the steady state level and provides a pre-heating end signal when the chopper output reaches the steady state level. The inverter controller causes the inverter to operate in the limited mode in response to the pre-heating start signal and allows the inverter to operate in the normal mode in response to the pre-heating end signal.

The inductor of the chopper may be provided with a secondary winding which is connected in series with a capacitor for charging the capacitor by a voltage induced at the secondary winding. Thus charged capacitor provides an operating voltage to the inverter controller such that the inverter controller is enabled to operate the inverter in the limited mode in a delayed manner after the start-up of the chopper which is initiated by the operation of the switching element of the chopper. This arrangement constitutes the delay circuit for energizing the inverter controller in a delayed manner from the start-up of the chopper.

The ballast of the present invention may includes a dummy load which is connected to the chopper output in parallel with the inverter. With the presence of the dummy load, the chopper can be always operated with a certain load connected to the chopper output, particularly when the inverter is not active, and therefore be well prevented from producing over-voltage for safe operation of the ballast, which is therefore a still further object of the present invention.

A switch may be provided to disconnect the dummy load the chopper upon the chopper output becoming the steady state level. Further, the dummy load is provided in the form of a heater disposed around the discharge lamp for preheating the lamp when the inverter is not active, thereby correspondingly shortening the lighting of the discharge lamp by the subsequent operation of the inverter, which is therefore a still further object of the present invention. The switch may comprises a timer for disconnecting the dummy load after a predetermined time period which is selected to be not less than a time period required for the chopper to produce the steady state chopper output after the start-up of the chopper.

For preheating the discharge lamp, the inductor may be provided with a pair of secondary windings which produce induced voltages to be fed respectively to the cathodes of the discharge lamp.

These and still further objects and advantageous features of the present invention will become apparent from the following description of preferred embodiments when taken in conjunction with the attached drawings.

DETAILED DESCRIPTION OF THE PREFERRED EMBODIMENTS

Figure 1:
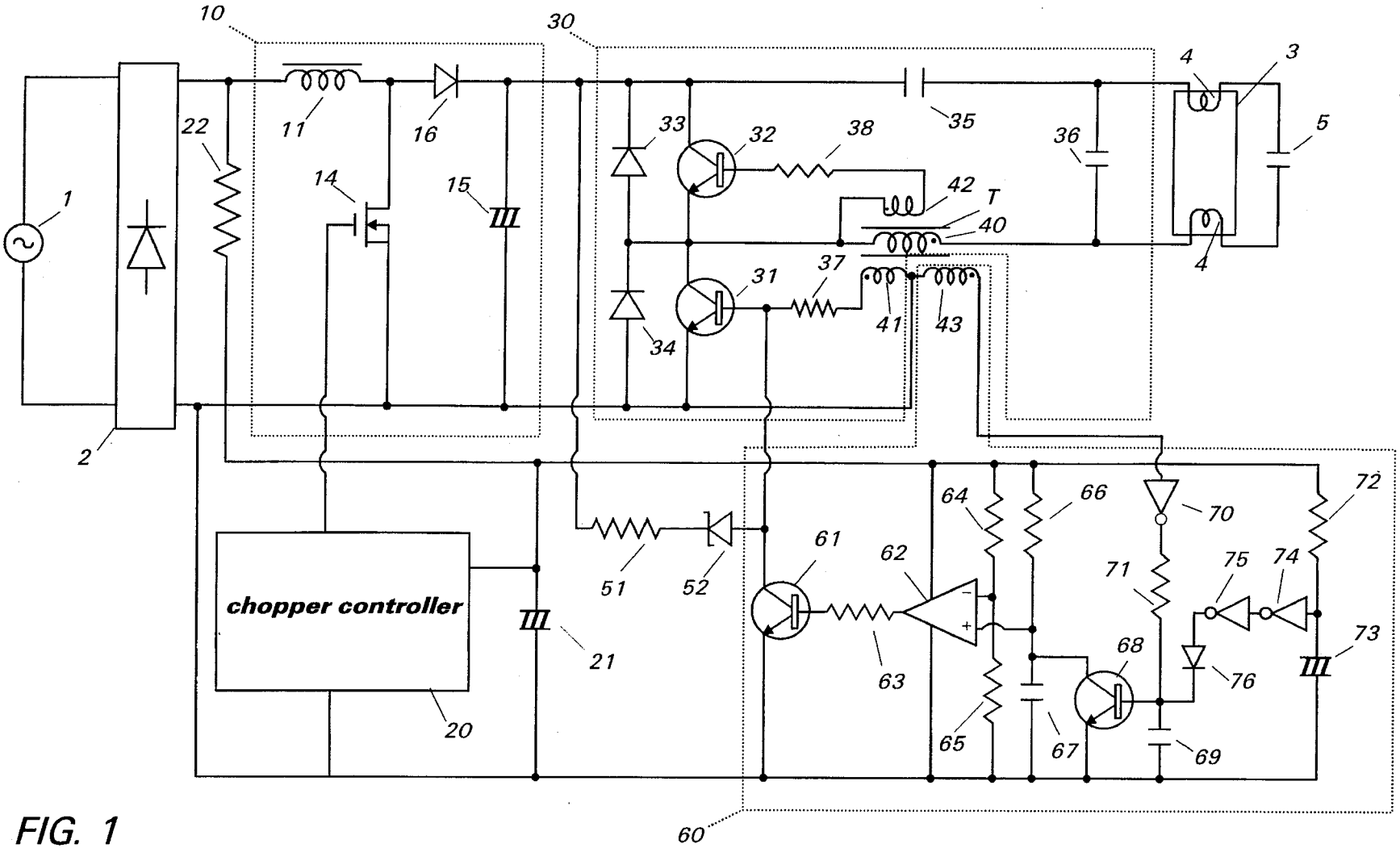
FIG. 1 is a circuit diagram of an electronic ballast in accordance with a first embodiment of the present invention.

First Embodiment <FIGS. 1 and 2>

Referring now to FIG. 1, there is shown an electronic ballast for a hot cathode discharge lamp in accordance with a first embodiment of the present invention. The ballast comprises a chopper 10 and an inverter 30. The chopper 10 is connected through a fullwave rectifier 2 in the form of a diode bridge to an AC mains 1 to receive a rectified pulsating DC voltage therefrom and provides a step-up DC voltage as a chopper output to the inverter 30. The inverter 30 produces a high frequency AC voltage for driving the discharge lamp 3. The chopper 10 and the inverter 30 are respectively controlled by a chopper controller 20 and an inverter controller 60.

The chopper 10 comprises an inductor 11 and a MOSFET 14 which are connected in series across the fullwave rectifier 2 so that MOSFET 14 interrupts the pulsating DC voltage from the fullwave rectifier 2 periodically to induce the chopped voltage at the inductor 11. Thus induced voltage is applied together with the DC voltage from the rectifier 2 to charge a smoothing capacitor 15 through a blocking diode 16 for providing a smoothed step-up DC voltage to the inverter 30.

Figure 2A:
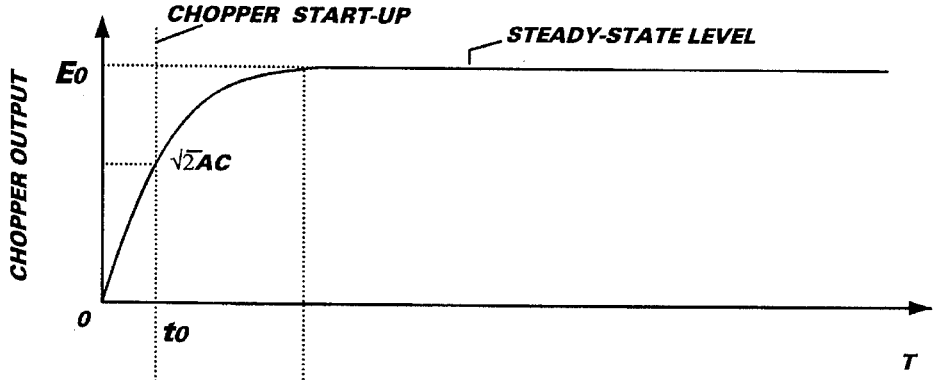
FIGS. 2A and 2B are waveform charts illustrating the operations of the ballast circuit of FIG. 1.

The chopper controller 20 is energized by a capacitor 21 to provide driving pulses to gate of MOSFET 14 for turning on and off MOSFET 14 at a high frequency. The capacitor 21 is connected in series with a resistor 22 across the rectifier 2 and is charged up to a level sufficient for enabling the chopper controller 20 after a short period $t_0$ determined by a time constant of capacitor 21 and resistor 22 from the very start of connecting the ballast to the AC mains 1. The short period $t_0$ is normally set to be about several tens of milliseconds within which the chopper output increases to a peak voltage ($\sqrt{2}$AC) of the AC mains 1, as shown in FIG. 2A. Thereafter, MOSFET 14 is made active to start adding the chopped voltage to the smoothing capacitor 15, thereby increasing the chopper output to a steady state level $E_0$ after a subsequent transient period, as shown in FIG. 2A.

The inverter 30 comprises a pair of first and second transistors 31 and 32 connected in series across the smoothing capacitor 15 and which are alternately turned on and off so as to apply an oscillating voltage from the smoothed chopper output to the discharge lamp 3. The first transistor 31 and second transistor 32 are shunted respectively in anti-parallel relation by first and second diode 34 and 33. Also included in the inverter 30 are capacitors 35 and 36, and a transformer T with a primary winding 40 and three secondary windings 41 to 43. The primary winding 40 and the capacitor 35 are connected in series with the discharge lamp 3 to define a series resonance circuit connected across the second transistor 32 with the capacitor 36 connected across the lamp 3. The first and second secondary windings 41 and 42 define themselves feedback windings respectively connected to bases of the first and second transistors 31 and 32 through respective resistors 37 and 38 for self-excitation thereof, the details of which will be discussed hereinafter.

Figure 2B:
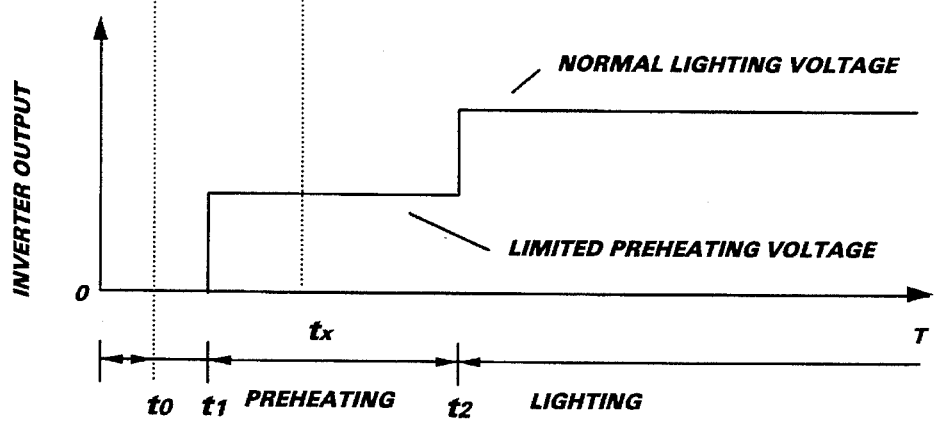

A series combination of a resistor 51 and a zener diode 52 is connected across the smoothing capacitor 15 in series relation with a base-emitter path of the first transistor 31 so as to apply a starting bias thereto from the chopper output when the smoothing capacitor 15 is charged up to a predetermined level. That is, when the chopper output increases to a predetermined level after the start-up of the ballast circuit, zener diode 42 becomes conductive to apply the starting bias to the first transistor 31 to turn it on. As shown in FIG. 2B, this timing is selected to be later than the timing at which the chopper 10 becomes active to start producing the chopped voltage. In this sense, the series combination of resistor 51 and zener diode 52 acts as a delay circuit for delaying the start-up of the inverter 30 from the start-up of the chopper 10 such that the inverter 30 is made active only after the chopper output increases to the predetermined level.

The first transistor 31 is also connected to an inverter controller 60 so that the inverter 30 is controlled to operate either in a normal operation mode of producing a driving voltage for lighting the discharge lamp 3 and in a limited operation mode of producing a reduced voltage of substantially constant level for preheating the discharge lamp 3. The inverter controller 60 includes a transistor 61 which is connected between the base-emitter path of the first transistor 31 with a collector of the transistor 61 coupled to zener diode 52. The transistor 61 is controlled to be kept turn off in the normal operation mode and to be turned on and off in the limited operation mode.

Prior to discussing the operation of the inverter controller 60, the self-excited inverter operation is now discussed under the condition in which the transistor 60 is kept turned off.

1) When the starting bias is applied to turn on the first transistor 31, the inverter 30 starts operating to flow a current from the chopper output, i.e., capacitor 15 through capacitor 35, cathodes 4 of the discharge lamp 3, capacitor 5, primary winding 40, and first transistor 31, while charging capacitor 35.
2) When the current flows to a point where it induces no further expanding magnetic field around primary winding 40, the voltage developed across first feedback winding 41 is reduced to thereby turn off the first transistor 31, after which the primary winding 40 continues to flow the current in the same direction through diode 33 instead of transistor 31, capacitor 35, and cathodes 4 of the discharge lamp 3, with attendant collapsing magnetic field.
3) In response to the collapsing magnetic filed, the second feedback winding 32 induces a forward bias to turn on the second transistor 32. The winding sense of windings 40 to 43 is indicated in FIG. 1 by means of polarity dots. Upon this occurrence, the second transistor 32 becomes conductive to flow a current of opposite direction from capacitor 35 through second transistor 32, primary winding 40, cathodes 4 and back to capacitor 35.
4) When the current flows to a point where it induces no further expanding magnetic field around primary winding 40, the voltage developed across the second feedback winding 42 is reduced to turn off the second transistor 32. Immediately after second transistor 32 is turned off, primary winding 40 acts also to continue flowing the current through discharge lamp 3, capacitor 35, smoothing capacitor 15, and through second diode 34 across first transistor 31.

In this manner, the above steps are repeated so that the resonance circuit of the inverter can provide an oscillating current flowing in the opposite directions with an on-time duration determined by a circuit constant of the resonance circuit. The inverter 30 in this normal operation mode produces the high frequency output voltage at a frequency around a resonance frequency of the resonance circuit.

Now turning back to the inverter controller 60, it includes a comparator 62 of which output is connected to a base of the transistor 61 through a resistor 63. The comparator 62 has its inverting input connected to a connection point between resistors 64 and 65 connected in series across the capacitor 21 which provides the operating voltage to the chopper controller 20, and has its noninverting input connected to a point between a resistor 66 and a capacitor 67 which are connected in series also across the capacitor 21. The capacitor 67 is in circuit to be charged by the voltage from capacitor 21 and is shunted by another transistor 68 with a capacitor 69 connected across base-emitter path of transistor 68. The inverter controller 60 further includes the third feedback winding 43 which induces voltage opposed in polarity to that of the first feedback winding 41 upon turning on of the first transistor 31. The third feedback winding 43 is coupled to a base of transistor 68 through a NOT gate 70 and a resistor 71 such that the induced voltage at the third feedback winding 43 in inverted at NOT gate 70 and in turn acts to pull the forward bias to turn off transistor 68. Also connected across the capacitor 21 is a series combination of a resistor 72 and a capacitor 73 which is charged by the voltage from the capacitor 21 through resistor 72 and which applies thus charged voltage to the gate of transistor 68 through a series circuit of NOT gates 74 and 75 and diode 76.

Operation of the inverter controller 60 is now discussed. Prior to the proceeding the discussion, it should be noted that the transistor 61 is enabled to turn on and off only for a limited time interval from the energization of the circuit to a time $t_2$ when the capacitor 73 is charged by the voltage from the capacitor 21 up to a critical level sufficient to apply the constant forward bias to transistor 68. This time interval is selected to be about one second from the energization of the circuit within which the chopper output is expected to become a steady state level. Once the capacitor 73 is charged up to the critical level, the transistor 68 is kept conductive irrespective of the output from the NOT gate 70, i.e., the third feedback winding 43. When transistor 31 is turned on to start providing the inverter output to the discharge lamp 3, the third feedback winding 43 applies the induced voltage to NOT gate 70 which in turn pulls the forward bias to transistor 68 to turn it off. Upon this occurrence, the capacitor 67 is connected in circuit to begin being charged by the voltage from the capacitor 21 through resistor 66. After a predetermined period determined by a time constant of resistor 66 and capacitor 67, the capacitor 67 is charged up to a certain level higher than a divided voltage fed to the inverting input of comparator 62. Immediately thereafter, the comparator 62 responds to apply the forward bias to the base of transistor 61 to turn in on, which in turn shunts the base-emitter path of the first transistor 31 to turn it off before the feedback winding 41 acts to turn off the first transistor 61. After thus overriding turn off of the first transistor 31, the third feedback winding 43 develops a reverse voltage at the same time the second feedback winding 42 acts to turn on the second transistor 32. The reverse voltage from the third feedback winding 43 in turn causes the transistor 68 to turn on, thereby discharging the capacitor 67 and therefore turning off transistor 61 so that the first transistor 31 is made ready to be subsequently turned on by the induced voltage applied the base thereof.

In this manner, the normal ON-period of the first transistor 31, which is determined by the self-exciting circuit configuration of the inverter, is reduced to limit the inverter output from the start-up of the inverter 30 for the short time period $t_2-t_1$ (indicated in FIG. 2B), which defines the limited operation mode of the inverter 30. It is noted that thus reduced ON-period of the first transistor 31 is determined by a time constant of resistor 66 and 67 in relation to divided voltage fed to the inverting input of comparator 62. Therefore, in the limited operation mode, the ON-period of transistor 31 is reduced by a constant extent to limit the inverter output to substantially a constant level, as shown in FIG. 2B, for preheating the cathodes 4 of the discharge lamp 3 in a controlled manner without causing undesired abnormal oscillation of the inverter 30. In addition, although the ON-period is reduced, OFF-period of transistor 31, i.e., ON-period of transistor 32 is kept substantially constant due to the self-exciting circuit configuration. However, the inverter 30 can be said to increase its frequency in the limited operation mode beyond the resonance frequency of the inverter circuit as in the normal operation mode. Further, it is noted that resistor 72 and capacitor 73 define a timer circuit which determines the end of the limited operation mode before which the chopper output is expected to increase the steady state level (of which timing is indicated by a line $t_x$ in FIG. 2B). Once the capacitor 73 is charged up to the critical level to terminate the limited operation mode, the inverter 30 comes into the normal operation mode in which the transistors 31 and 32 are allowed to turn on and off in the self-excited manner as described in the above to apply a driving voltage to the discharge lamp 3 for lighting thereof.

Figure 3:
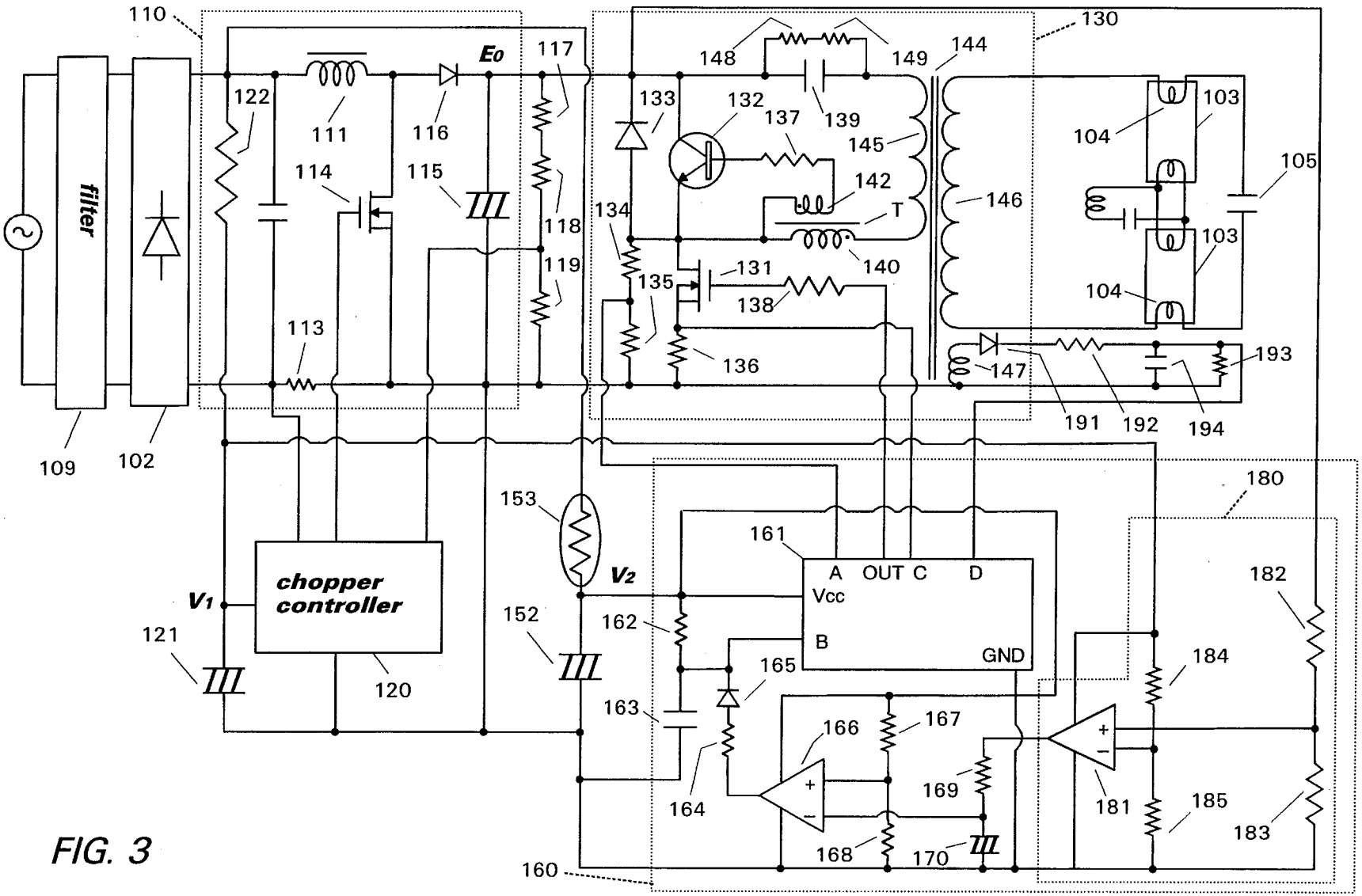
FIG. 3 is a circuit diagram of an electronic ballast in accordance with a second embodiment of the present invention.

Second Embodiment <FIGS. 3 and 4>

Figures 4A, 4B, 4C, 4D, 4E:
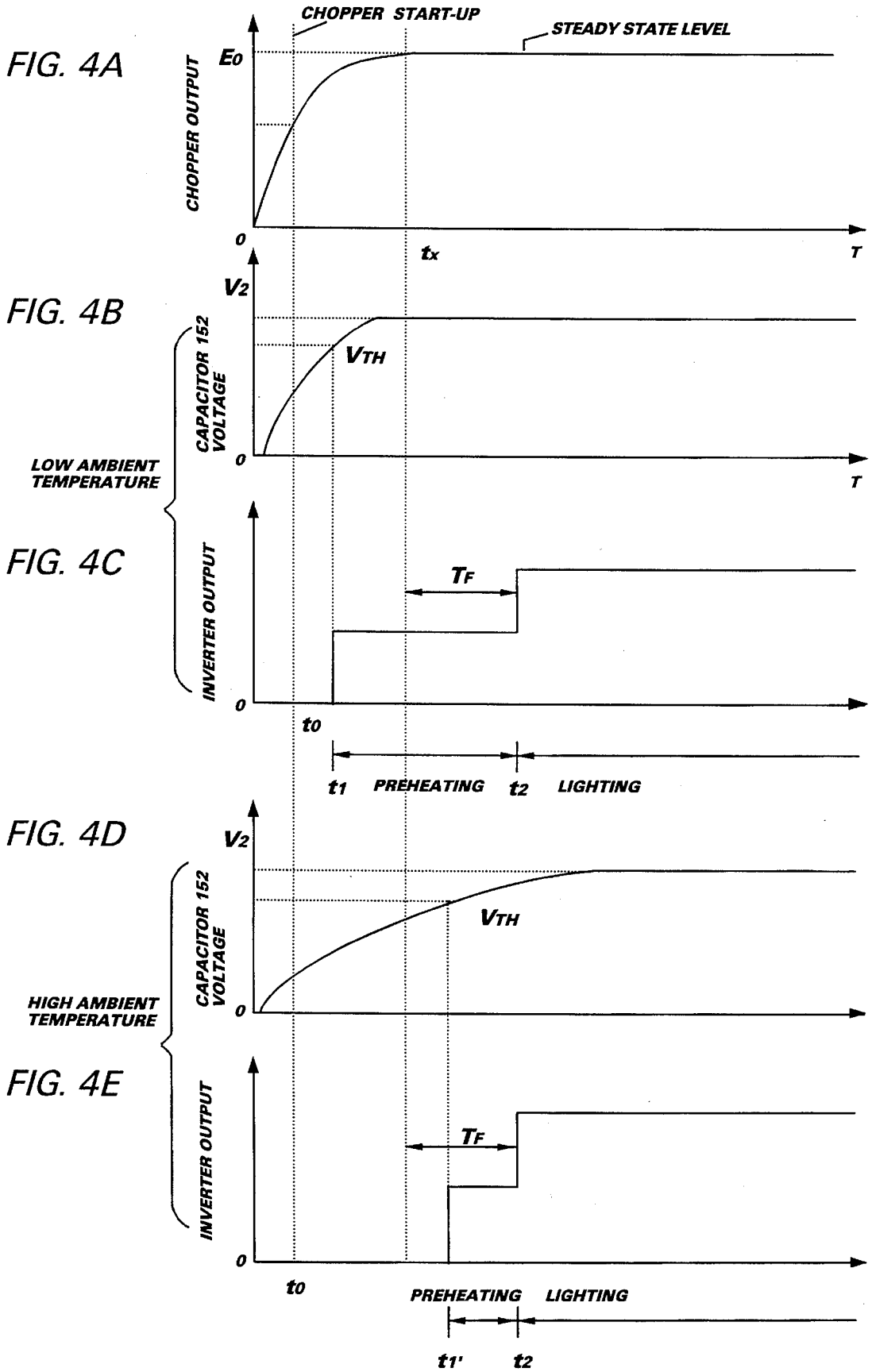
FIGS. 4A to 4E are waveform charts illustrating the operations of the ballast circuit of FIG. 3.

FIG. 3 illustrates an electronic ballast in accordance with a second embodiment of the present invention which includes a chopper 110 and a chopper controller 120 of the like configurations to those of the first embodiment but includes an inverter 130 and an inverter controller 160 of different configurations from those of the first embodiment. The chopper 110 comprises an inductor 111, MOSFET 114, smoothing capacitor 115, blocking diode 116 arranged in the like manner as in the first embodiment to produce a step-up smoothed voltage across the capacitor 115 by periodically interrupting the DC voltage from the fullwave rectifier 102 which is connected to an AC mains 101 through a filter 106. The chopper controller 120, which is connected to MOSFET 114 to alternately turn on and off, is energized by a charged voltage at a capacitor 121 connected in series with a resistor 122 across the rectifier 102. Thus, the chopper 110 is enabled to add the chopped voltage to the smoothing capacitor 115 in a delayed manner from the energization of the ballast circuit by an initial transition period determined by a time constant of resistor 122 and capacitor 121 (as is in the first embodiment), which is also shown in FIG. 4A. Additionally included in the chopper 110 is a voltage divider network of resistors 117 to 119 which provides an divided voltage to the chopper controller 120 in order that the chopper 110 is controlled in a feedback manner to provide a constant chopper output across the smoothing capacitor 115. A resistor 113 is connected between the source of MOSFET 114 and the rectifier 102 to provide a monitored voltage to the chopper controller 120 in which it is utilized for controlling to turn on and off MOSFET 114.

The inverter 130 comprises first transistor MOSFET 131 and a second transistor 132 which are connected in series across the smoothing capacitor 115 and which are alternately turned on and off so as to apply an oscillating voltage to the discharge lamps 103 through a transformer 144 with a primary winding 145 and a secondary winding 146. Also included in the inverter 130 are a transformer T with a primary winding 140 and a secondary winding 142 and a capacitor 139. The primary winding 140 is connected in series with capacitor 139 and primary winding 145 to define a series resonance circuit. Resistors 148 and 149 are connected in series across the capacitor 139. A voltage divider of resistors 134 and 135 are connected across a series combination of first transistor and a resistor 136. The second transistor 132 is shunted by a diode 133 in an anti-parallel relation thereto. The secondary winding 142 defines a feedback winding connected through a resistor 137 to a base of second transistor 132 for self-excitation thereof. The first transistor 131 has its gate connected through a resistor 138 to the inverter controller 160 and is controlled thereby to turn on and off.

A series combination of a thermistor of positive temperature coefficient 153 and a capacitor 152 is connected across the smoothing capacitor 115 to charge capacitor 152 by the voltage from the rectifier 102 up to a threshold level after a short time period from the energization of the ballast circuit. Upon reaching the threshold level, capacitor 152 supplies an operating voltage to enable the inverter controller 160. Due to the inclusion of thermistor of positive temperature coefficient 153, the time period required for capacitor 152 to be charged to the predetermined level is dependent upon the ambient temperature. That is, capacitor 152 is charged earlier as the ambient temperature is higher, thereby expediting the start-up of the inverter controller 160, or the operation of the inverter 130.

The inverter controller 160 controls basically to turn on the first transistor 131 at a timing dependent upon the turn-off timing of second transistor 132 and further controls to vary an on-time duration of first transistor 131 in such a manner as to operate the inverter in a limited operation mode of providing a limited inverter output during an initial period from the start-up of the inverter and in a normal operation mode of providing a lamp driving voltage after the elapse of the initial period. The end of the initial period, or limited operation mode is determined to come later than a time at which the chopper output increases to a steady state level so that the inverter 130 goes into the normal operation mode only after the chopper output becomes the steady state level, the detail of which will be discussed hereinafter.

For easy understanding of the inverter operation, an explanation is firstly made to the normal operation mode. The inverter controller 160 comprises a mono-stable multi-vibrator 161 which produces an output pulse at output terminal OUT for turning on and off first transistor 131 after the voltage supplied to Vcc terminal of multi-vibrator 161 from the capacitor 152 reaches the threshold level.

1) When the multi-vibrator 161 receives low-level signal respectively at its terminals A and C, it produces a high level output from output terminal OUT for a time interval determined by a time constant of resistor 162 and a capacitor 163 which are connected across the capacitor 152. That is, when the capacitor 163 is charged by capacitor 152 up to a certain level (which is referred hereinafter referred to as cut-off level) which is fed to a terminal B of multi-vibrator 161, multi-vibrator 161 responds to produce a low level output to turn off first transistor 131. At this time, the capacitor 163 is discharged through an internal circuit (not seen) of multi-vibrator 161 to decrease its voltage below the cut-off level ready for subsequent charging by capacitor 152. During the ON-period of transistor 131, a current is caused to flow from smoothing capacitor 115 through a loop of the resonance circuit, i.e., capacitor 139, transformer 144, primary winding 140, first transistor 131, and back to smoothing capacitor 115, while charging capacitor 139 by that current.

2) Upon subsequent turn-off of first transistor 131, primary winding 140 acts to continue flowing a current in the same direction now through diode 133 to capacitor 139, while at the same time primary winding 140 responds to collapse an electromagnetic field therearound for developing at feedback winding 142 a positive bias applied to the base of second transistor 132 for self-excitation thereof. Accordingly, immediately after no further current flows through first diode 133 into capacitor 139, second transistor 132 becomes conductive to flow a current from capacitor 139 through second transistor 132, primary winding 140, transformer 144, and back to capacitor 139.

3) When the current flows to a point where it induces no further expanding magnetic field around primary winding 140, the voltage developed across feedback winding 142 is reduced to turn off second transistor 132.

4) Immediately after second transistor 132 is turned off, primary winding 140 acts also to continue flowing current through transformer 144, capacitor 139, smoothing capacitor 115, and parasitic diode (not shown) inherent to first transistor MOSFET 131, which condition is detected by divided voltage of resistors 134 and 135 connected across first transistor 131. At this condition, the divided voltage is monitored as a low level signal at terminal A of the multi-vibrator 161. By this time, terminal C of the multi-vibrator 161 receives low level signal from resistor 136 so that the multi-vibrator 161 is again triggered to turn on first transistor 131.

In this manner, the above steps are repeated so that the resonance circuit of the inverter can provide an oscillating current flowing in the opposite directions with an on-time duration determined by a circuit constant of the resonance circuit for driving the discharge lamps 103 through transformer 144 at about a resonance frequency of the inverter.

Now a discussion is made to the limited operation mode of the inverter with additional configurations of the inverter controller 160. The inverter controller 160 further includes a series circuit of a resistor 164 and a diode 165 which are to be connected in parallel relation to resistor 162 only for a certain period after the start-up of the inverter controller 160. During this period which defines the limited operation mode for preheating the discharge lamps, it is made to speed-up the charging of capacitor 163 to thereby shorten the ON-period of first transistor 131 and-therefore limit the inverter output. To this end, the inverter controller 160 includes a voltage detector 180 composed of a comparator 181, a first divider of resistors 182 and 183, and a second divider of resistors 184 and 185. The first divider of resistors 182 and 183 are connected across the smoothing capacitor 115 of chopper 110 to define a voltage monitor for the chopper output and provides to noninverting input of comparator 181 a divided voltage indicative of the chopper output, while second divider of resistors 184 and 185 are connected across the capacitor 121 to provide substantially constant voltage to inverting input of comparator 181 as a reference voltage. The output of comparator 181 is connected to the ground through a series connected resistor 169 and a capacitor 170. When the chopper output increases to the steady state level, comparator 181 responds to provide a high level output for charging capacitor 170 up to a certain level for a time period determined by a time constant of resistor 169 and capacitor 170. Another comparator 166 is included in circuit to have its inverting input connected to receive voltage developed across capacitor 170 and have its noninverting input connected to receive a reference level obtained by dividing voltage of capacitor 152 by resistors 167 and 168. The output of comparator 166 is connected to the capacitor 163 through resistor 164 and diode 165 so that comparator 166 acts to connect the resistor 164 in parallel relation to the resistor 162 only when comparator 166 provides a high level output in response to the condition in which capacitor 170 is not yet charged enough to exceed the reference level received at the noninverting input.

Operation of the inverter in the limited operation mode is now explained with reference to FIGS. 3 and 4A to 4E. After a short time period when the chopper controller 120 is made active to start-up the chopper 110 in response to receiving the operating voltage from capacitor 121 at a time indicated by $t_0$ in FIGS. 4A to 4E, capacitor 152 is charged through thermistor 153 to have its voltage $V_2$ reaching the threshold voltage $V_{TH}$ at time t1 in FIG. 4C (time t1' in FIG. 4E), whereby the inverter controller 160 becomes active to firstly turn on first transistor 131. After the inverter controller 160 is made active but until capacitor 170 is charged up to the reference level of comparator 166 at a time $t_2$ which comes only after the chopper output reaches the steady state level (time $t_x$ in FIG. 4A), comparator 166 holds high level output in order to keep the resistor 164 and diode 165 connected in parallel relation to resistor 162, thereby speeding up the charging of capacitor 163. As discussed hereinbefore, as soon as capacitor 163 is charged up to the cut-off level received at terminal B, multi-vibrator 161 responds to turn off first transistor 131. This means that time for charging capacitor 163 to the cut-off level defines the ON-period of first transistor 131. Accordingly, under this condition, capacitor 163 is charged faster due to the parallel connection of resistor 164 to resistor 162 than in the condition where no such parallel connection of resistor 164 and resistor 162 is made as is in the normal operation mode, thereby reducing ON-period of first transistor 131.

Subsequent to the turn off of first transistor 131, the inverter 130 operates to turn on and off second transistor 132, and again turn on first transistor 131 in the like manner as explained hereinbefore with reference to the normal operation mode. Therefore, during this period from t1 to t2, the ON-period of first transistor 131 is reduced while leaving the ON-period of second transistor 132 substantially unchanged, the inverter 130 increases its switching frequency beyond the resonance frequency so as to limit the inverter output to substantially constant level suitable for preheating the cathodes 104 of the discharge lamps 103.

When the voltage detector 180 detects the chopper output reaching the steady state level, comparator 181 responds to start charging capacitor 170. After a fixed time period $T_F$, capacitor 170 is charged to exceed the reference voltage of comparator 166 so that comparator 166 responds to disconnect an additional charging path of resistor 164 and diode 165 from a main charging path of resistor 162 for capacitor 163, thereby slowing down the charging time of capacitor 163 back to the normal time. Thus, the inverter 130 is switched into the normal operation mode for providing the increased voltage for lighting the discharge lamps 103. In this sense, the circuit of capacitor 170 and resistor 169 may be referred to as a timer for determining the end of the limited operation mode.

It should be noted in this connection that, as seen from comparison of FIGS. 4B and 4C to FIGS. 4D and 4E, when the ambient temperature goes high, thermistor of positive temperature coefficient 153 acts to delay charging capacitor 152 to the threshold voltage $V_{TH}$ to thereby correspondingly delay the start-up the inverter controller 160 for operating the inverter 130 in the limited operation mode. As seen in the figures, the start-up of the inverter in a low ambient temperature is indicated at time $t_1$ in FIG. 4C, while the start-up in the high ambient temperature is at $t_2$ in FIG. 4E. However, as discussed before, since the end of the limited operation mode is determined by the timer of resistor 169 and capacitor 170 and is not dependent upon the start-up time of the inverter, the discharge lamps 103 is turned on irrespective of an ambient temperature change but with a differing preheating time. This is very consistent with the discharge lamp characteristics that the cathodes 104 requires a less preheating time at a higher ambient temperature than at a lower ambient temperature, and consistent with an user's demand that the lamp is to be lighted after a constant time interval from turning on the ballast free from changes in the environmental temperature. Further, the above feature is found advantageous in reducing the preheating time when the ballast is turned on immediately after the turn off and in that the user is not rendered curious about otherwise occurring fluctuation of time in lighting the discharge lamps in differing temperature environment or in the case when the lamp is turned on again immediately after the turn-off.

The ballast additionally includes an output monitor composed of an auxiliary winding 147 coupled to the primary winding 145 of transformer 144, diode 191, resistors 192 and 193, and capacitor 194. Thus configured monitor provide a corresponding DC voltage to terminal D of multivibrator 161. When the monitored DC voltage exceeds a safe level due to an unexpected abnormal oscillation, for instance, the multi-vibrator 161 responds immediately to stop providing the high level signal to first transistor 131, thereby ceasing the inverter operation for protection of the inverter. Further, the DC voltage from the output monitor may be utilized to keep the inverter output at a constant level in a feedback manner both in the limited and normal operation modes. It is noted in this connection that although the limited operation mode may be initiated before the chopper output reaches the steady state level, the inverter 130 is controlled to operate at substantially a constant frequency for producing a limited output of substantially constant level. Therefore, the inverter can be well protected from causing undesired abnormal oscillation which might otherwise occur due to unstable chopper output. Further, since the inverter output is kept constant even in the limited operation mode, the DC voltage from the output monitor to terminal D may be utilized internally of the multivibrator to provide a reliable basis for protecting the inverter in case the abnormal inverter operation should occur in the limited operation mode.

Figure 6:
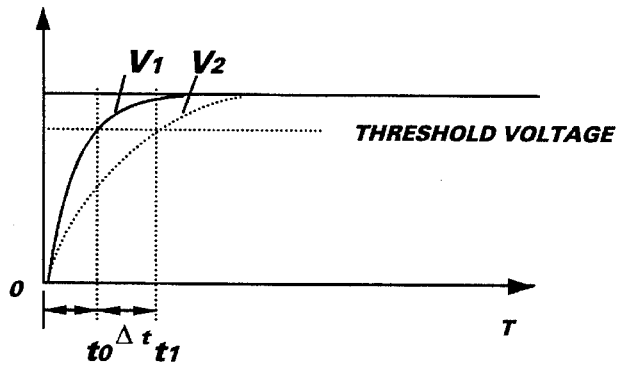
FIG. 6 is a waveform chart illustrating the operation of the ballast circuit of FIG. 5.
Figure 5:
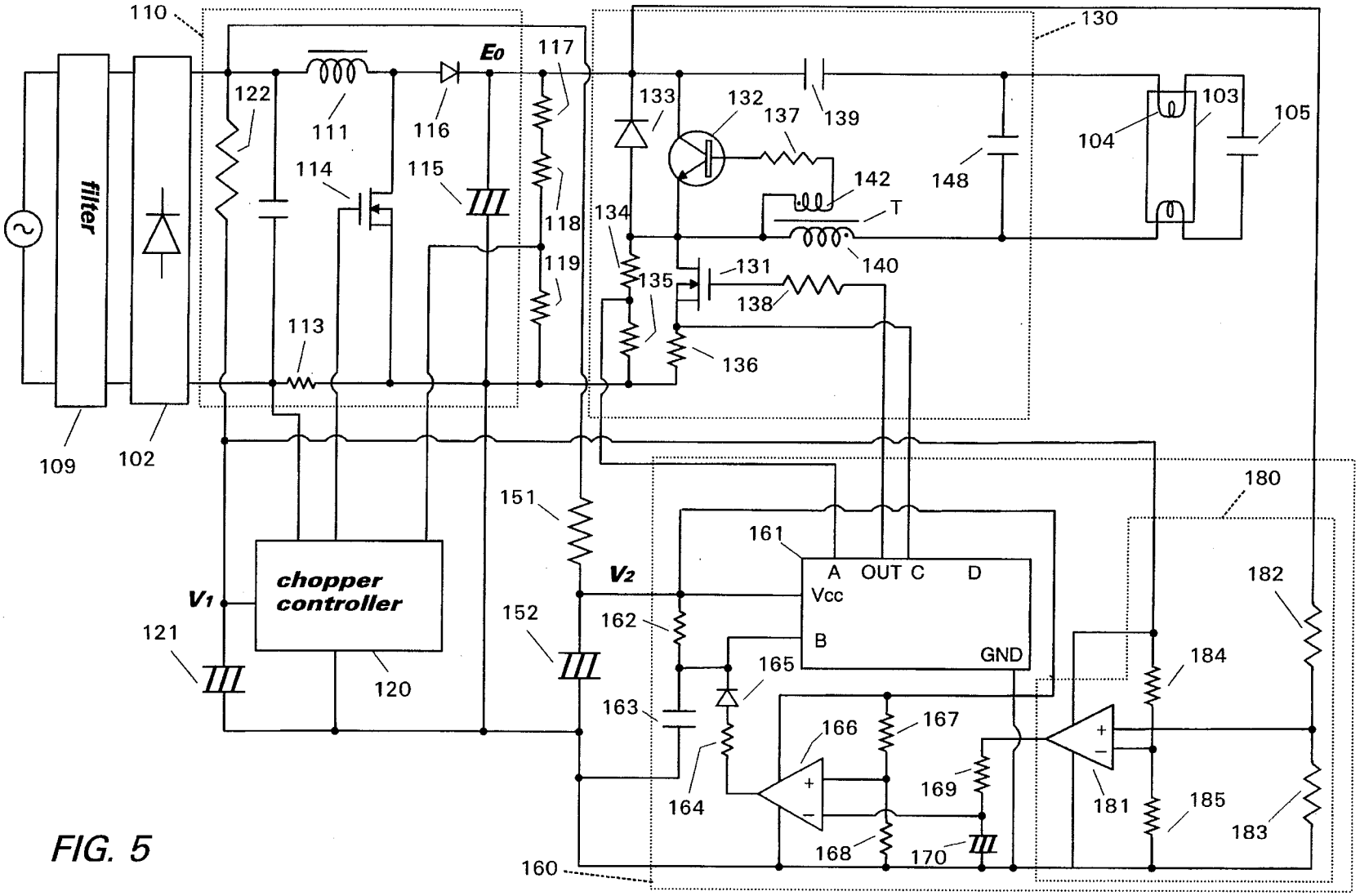
FIG. 5 is a circuit diagram of a first modification of the ballast circuit of FIG. 3.

FIG. 5 shows a modification of the second embodiment which is similar to the second embodiment except that a resistor 151 is utilized instead of thermistor 153 and that discharge lamp 103 is connected to the inverter 130 with an additional capacitor 146 instead of using the transformer 140. Like numerals are utilized throughout FIG. 5 to designate like parts in order to avoid duplicate explanation. In this modification, a combination of resistor 151 and capacitor 152 is selected to have a longer time period in charging capacitor 152 to develop voltage $V_2$ above threshold level for starting up the inverter 130 than the combination of resistor 122 and capacitor 121 does in developing voltage $V_1$ above threshold level for starting up the chopper 110, as shown in FIG. 6. That is, the inverter 130 is controlled to start-up with a delay $\Delta$ after the start-up of the chopper 110.

Figure 7:
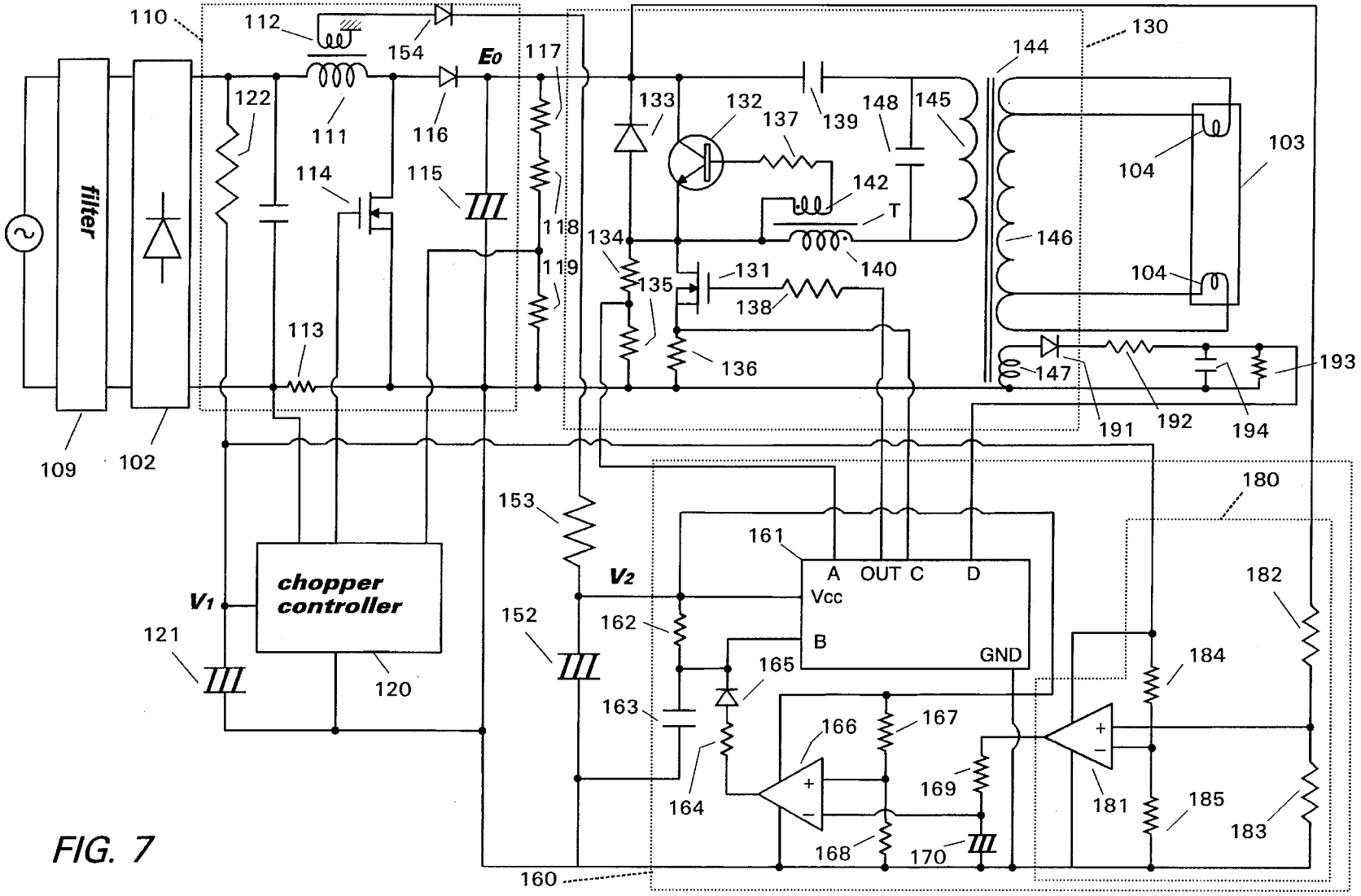
FIG. 7 is a circuit diagram of a second modification of the ballast circuit of FIG. 3.

FIG. 7 illustrates a second modification of the second embodiment which is identical to the second embodiment except that a secondary winding 112 is coupled to inductor 111 of the chopper 110 so as to provide an induced voltage for charging the capacitor 152 that provides an operating voltage to an inverter controller 160. Like numerals are employed to designate like parts to avoid duplication explanation. When the chopper 110 starts up to begin switching MOSFET 114 after a predetermined time period determined by a time constant of resistor 122 and capacitor 121, the secondary winding 112 acts to charge capacitor 152 through a diode 154 and a resistor 151 up to a threshold level and therefore starts up the inverter controller 160 in a delayed manner from the start-up of the chopper to operate the inverter 130 firstly in the limited operation mode and then in the normal operation mode, in the manner as described with reference to the second embodiment.

Figure 8:
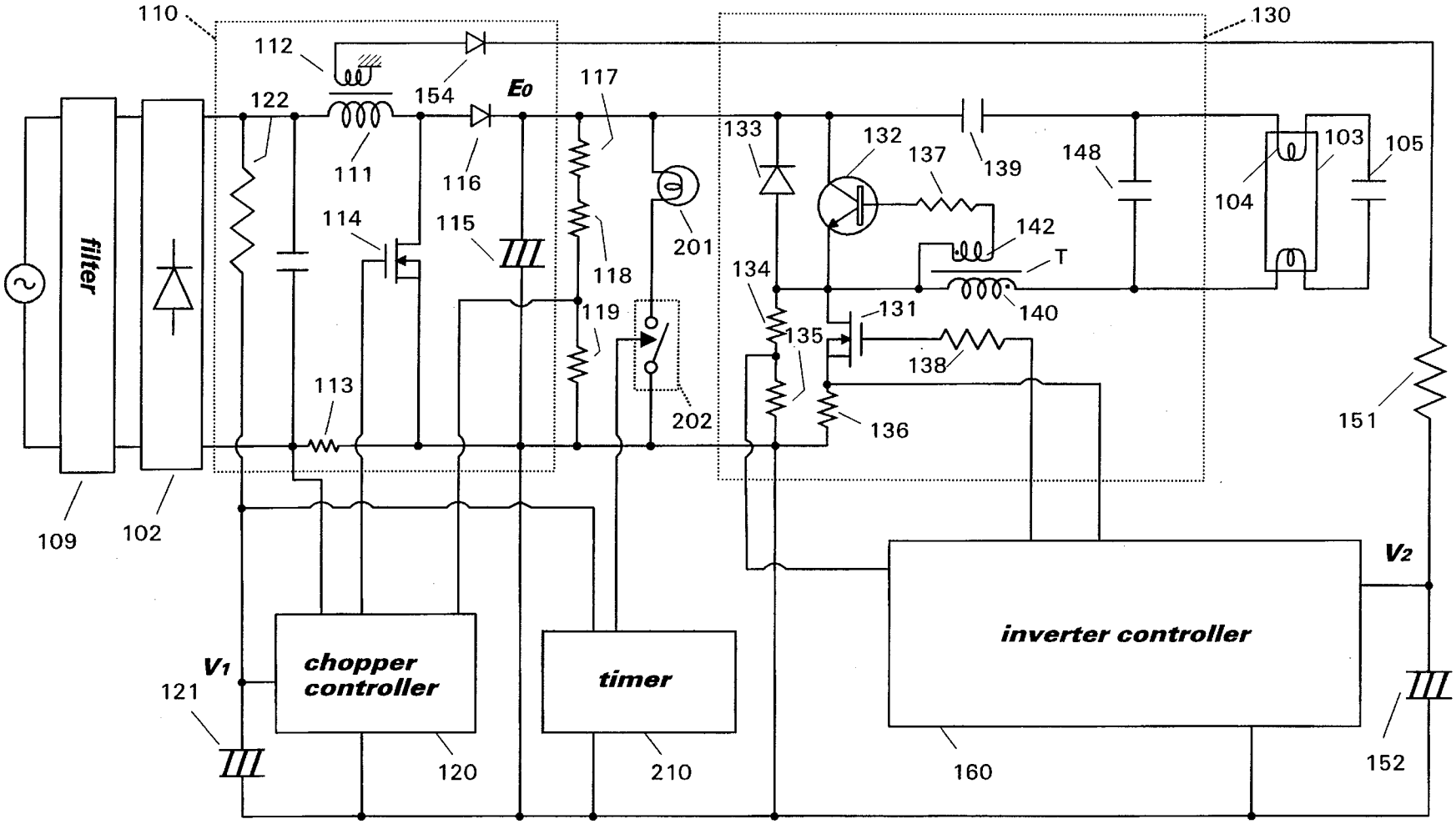
FIG. 8 is a circuit diagram of a third modification of the ballast circuit of FIG. 3.

FIG. 8 illustrates a third modification of the second embodiment which is similar to the second embodiment except that a dummy load 201 is connected to chopper output with a switch 202 connected in series with the dummy load 201 across the smoothing capacitor 115 of the chopper 110. The switch 202 is controlled by a timer 210 which counts a time period from start-up of the chopper 110 until the inverter 130 is expected to start up. During this time period, the timer 210 actuates to close the switch 202 for connecting the dummy load 201 to the chopper output temporarily so as to thereby prevent the chopper 110 from producing unduly high output which might otherwise possible under no load condition where the inverter is not yet active to consume the chopper output. Although the dummy load 201 is shown in FIG. 8 as an auxiliary incandescent lamp, it is not limited thereto and may be other suitable load, for example, a heater 203, as shown in FIG. 9.

Figure 9:
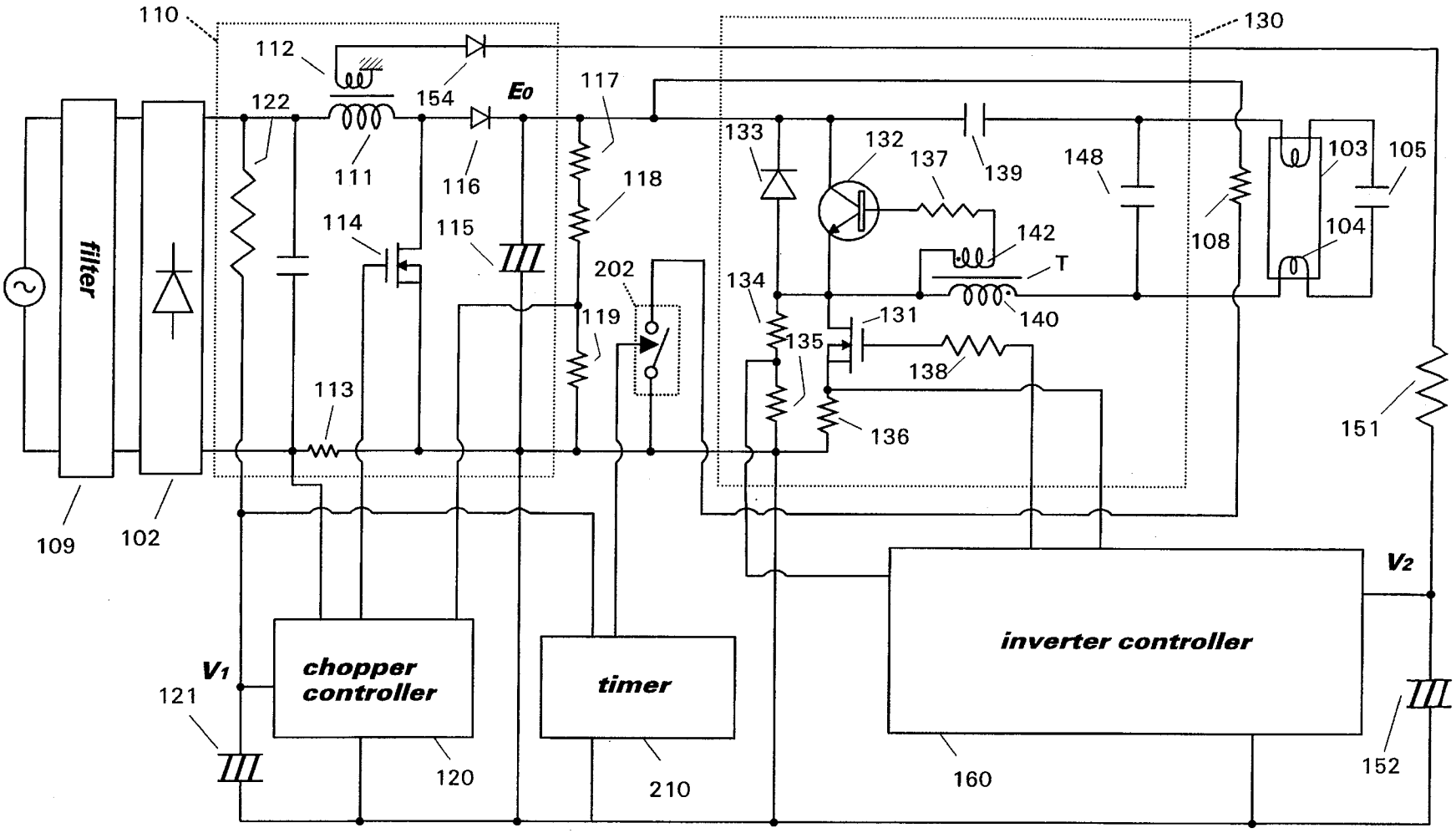
FIGS. 9 and 10 are schematic diagram of other modifications of the ballast circuit of FIG. 8, respectively.

In the circuit of FIG. 9, the heater 203 is disposed around the discharge lamp 103 so as to additionally preheat the lamp 103 for assuring effective preheating of the lamp in addition to the above described the limited operation of the inverter.

Figure 10:
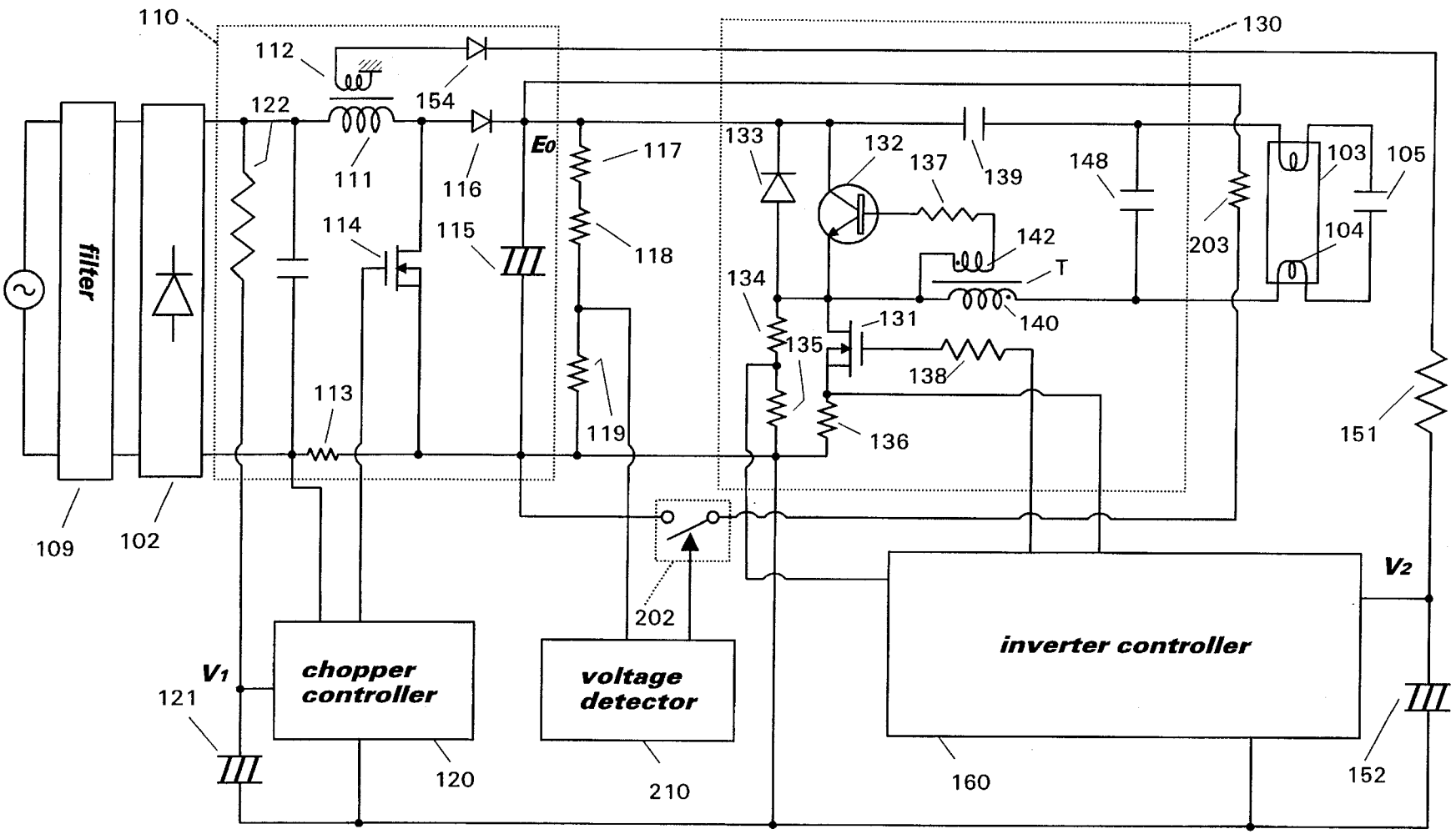

FIG. 10 illustrates a further modified ballast which is similar to the ballast of FIG. 9 except that a voltage detector 220 is utilized instead of the timer 210. The voltage detector 210 is connected to monitor the chopper output by receiving a divided voltage of resistors 117 to 119 connected across the smoothing capacitor 115, and actuates a like switch 202 for connecting the heater 203 to the chopper output when the chopper output exceeds a predetermined level and disconnecting the heater otherwise. Thus, even when the chopper produces unduly high output in response to the no-load condition, i.e., before the inverter is not yet become active, such voltage is best utilized to be fed to the heater 203 for preheating the discharge lamp 103.

Figure 11:
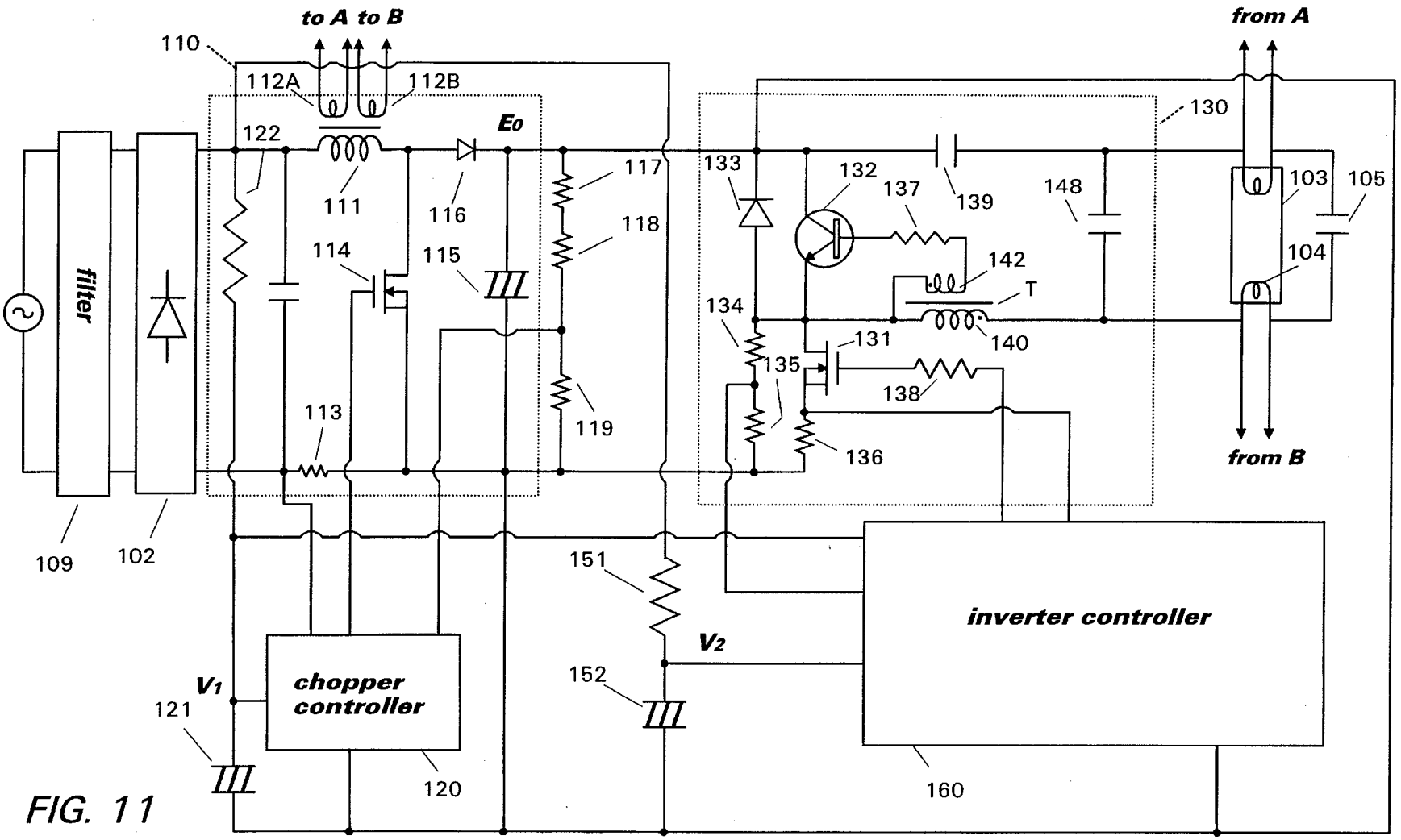
FIG. 11 is a schematic diagram of a further modification of the ballast circuit of FIG. 3.

FIG. 11 illustrates a still further modified ballast which is similar to the ballast of FIG. 5 except that an additional preheating of the discharge lamp 103 is made by the use of a pair of secondary windings 112A and 112B coupled to inductor 111 of the chopper 110. With this arrangement, even when the chopper 110 is made to produce unduly high output, the correspondingly increased voltages induced at the respective windings 112A and 112B are utilized to preheat the cathodes 104 of the discharge lamp 103, while releasing extra energy to avoid the chopper 110 from producing undesirable high output under substantially no-load condition. Although not shown in the figure, a switch may be added to disconnect the windings 112A and 112B from the cathodes 104 in response to the start-up of the inverter 130 so that the cathodes 104 can receive the induced voltage from the windings 112A and 112B only after the start-up of the chopper 110 and before the start-up of the inverter 130.

What is claimed is:

1. An electronic ballast for driving a hot cathode discharge lamp, comprising:

a DC voltage source;

a chopper comprising chopper switching means which is connected in series with an inductor across said DC voltage, said switching means being driven to turn on and off for providing a periodically interrupted voltage which is smoothed by a capacitor to produce a smoothed DC voltage as a chopper output;

an inverter comprising inverter switching means which is coupled to said chopper output to produce therefrom a high frequency AC voltage as an inverter output to be applied to cathodes of said discharge lamp;

an inverter controller which allows said inverter to operate selectively in a normal mode of providing said inverter output of a first level and in a limited mode of providing said inverter output of a second level which is substantially constant and which is lower than said first level and is determined to give a preheating current to said cathodes; and delay means for delaying the start-up of said inverter from the start-up of the chopper in such a manner as to enable said inverter to operate only after said chopper output increases to a predetermined level, said delay means initiating said inverter to operate in the limited mode before the chopper output reaches a steady state level,;

wherein:

said inverter controller controls said inverter to operate in said limited mode after the start-up of said inverter for a predetermined period to preheat said discharge lamp after which said inverter controller controls said inverter to operate in said normal operation mode for lighting said discharge lamp, said inverter controller controls said inverter to switch from said limited mode to said normal mode only after said chopper output reaches said steady state level, and said inverter provides said inverter output of said first level in said normal mode from said chopper output which is boosted to a steady level.

2. An electronic ballast as set forth in claim 1, wherein said inverter comprises a resonant circuit which provides a resonance voltage as said inverter output to said discharge lamp, and said inverter switching means capable of varying a frequency of said inverter output over a range including a resonance frequency of said resonant circuit, said inverter controller operating in said normal operation mode for producing said inverter output of a first frequency around said resonance frequency and operating in said limited operation mode for producing said inverter output of a second frequency higher than said first frequency.

3. An electronic ballast as set forth in claim 1, wherein said delay means provides a start-up signal to said inverter controller for initiating said limited operation mode at a timing dependent upon an ambient temperature such that the limited operation mode is initiated earlier as said ambient temperature becomes lower.

4. An electronic ballast as set forth in claim 3, further including a timer which starts counting a predetermined time duration upon said chopper output reaching the steady state level, said time producing an end signal upon termination of said time duration for switching said inverter from said limited operation mode to said normal operation mode such that said normal operation mode is initiated irrespective of the ambient temperature.

5. An electronic ballast as set forth in claim 3, wherein said delay means comprises a thermistor of positive temperature coefficient and a capacitor which are connected across the chopper output to charge said capacitor up to a threshold level at differing rates depending upon ambient temperature, said capacitor energizing said inverter controller to enable said inverter to operate in said limited operation mode upon charged up to said threshold level.

6. An electronic ballast as set forth in claim 1, wherein said inverter controller includes a voltage detector for said chopper output, said inverter controller including a timer which counts a predetermined time period after said chopper output is detected by said voltage detector to increase to a predetermined level and which issues a stop signal at the end of said time period to switch said inverter controller for operating said inverter in from the limited mode to said normal mode.

7. An electronic ballast as set forth in claim 1, wherein said delay means comprises a voltage detector for said chopper output and provides a pre-heating start signal when said chopper output reaches a predetermined level selected to be lower than said steady state level and provides a pre-heating end signal after said chopper output reaches said steady state level, said inverter controller causing said inverter to operate in said limited mode in response to said pre-heating start signal and allowing said inverter to operate in said normal mode in response to said pre-heating end signal.

8. An electronic ballast as set forth in claim 1, wherein said delay means comprises a secondary winding coupled to said inductor of said chopper, said secondary winding being connected through a resistor to a capacitor for charging said capacitor by a voltage induced at said secondary winding in response to the start-up of said chopper, said capacitor providing an operating voltage to said inverter controller such that said inverter controller is enabled to operate said inverter in said limited mode in a delayed manner after the start-up of said chopper.

9. An electronic ballast as set forth in claim 1, further including a dummy load which is connected to the chopper output in parallel with said inverter.

10. An electronic ballast as set forth in claim 9, further including switch means which disconnects said dummy load from said chopper in response to said chopper output reaching said steady state level.

11. An electronic ballast as set forth in claim 9, wherein said dummy load is a heater disposed around said discharge lamp for heating said cathodes.

12. An electronic ballast as set forth in claim 10, wherein said switch means is actuated by timer means to disconnect said dummy load after a predetermined time period which is selected to be not less than a time period required for said chopper to produce said steady state chopper output from the start-up of said chopper.

13. An electronic ballast as set forth in claim 1, wherein said inductor of said chopper includes a pair of secondary windings which produce induced voltages to be fed respectively to said cathodes for preheating said cathodes.

14. An electronic ballast as set forth in claim 13, further including switch means which disconnects said secondary windings from said cathodes in response to the chopper output reaching the steady state level.

* * * * *

UNITED STATES PATENT AND TRADEMARK OFFICE

CERTIFICATE OF CORRECTION

PATENT NO. : 5,565,740

DATED : October 15, 1996

INVENTOR(S) : Akinori HIRAMATSU, et al.

It is certified that error appears in the above-indentified patent and that said Letters Patent is hereby corrected as shown below:

Column 1, line 18, change "ballast" to --ballasts--.

Column 1, line 55, change "disclose" to --discloses--.

Column 1, line 66, change "achieved" to --conceived--.

Column 2, line 26, before "thus" insert --the--.

Column 2, line 31, change "prolong" to --prolonging--.

Column 3, line 5, delete "in".

Column 3, line 19, change "Thus" to --The thus--.

Column 3, line 27, change "includes" to --include--.

Column 3, line 37, after "load" insert --from--.

Column 3, line 38, change "becoming" to --reaching--.

Column 4, line 12, change "diagram" to --diagrams--.

Column 4, line 38, change "Thus" to --The thus--.

Column 5, line 6, after "themselves" insert --as--.

Column 5, line 34, change "turn" to --turned--.

Column 6, line 29, change "in inverted" to --is inverted--.

UNITED STATES PATENT AND TRADEMARK OFFICE

CERTIFICATE OF CORRECTION

PATENT NO. : 5,565,740

DATED : October 15, 1996

INVENTOR(S) : Akinori HIRAMATSU, et al.

It is certified that error appears in the above-indentified patent and that said Letters Patent is hereby corrected as shown below:

Column 6, line 38, delete "the" before "proceeding" and insert --with-- after "proceeding".

Column 6, line 61, change "turn in on" to --turn it on--.

Column 7, line 5, after "applied" insert --to--.

Column 7, line 63, change "an" to --a--.

Column 8, line 15, change "are" to --is--.

Column 8, line 35, change "as" to --when--.

Column 8, line 66, delete "referred".

Column 8, line 52, change "detail" to --details--.

Column 11, line 17, change "is" to --are--.

Column 11, line 20, change "requires a less" to requires less--.

Column 11, line 22, change "an" to --a--.

Column 12, line 6, change "$^{\Delta}$" to --$\Delta$t--.

Column 12, line 35, insert --be-- before "pos-".

UNITED STATES PATENT AND TRADEMARK OFFICE

CERTIFICATE OF CORRECTION

PATENT NO. : 5,565,740

DATED : October 15, 1996

INVENTOR(S) : Akinori HIRAMATSU, et al.

It is certified that error appears in the above-indentified patent and that said Letters Patent is hereby corrected as shown below:

Column 12, line 44, delete "the" before "limited".

Column 12, line 55, change "is" to --has--.

Column 14, line 14, before "charged" insert --being--.

Column 14, line 15, change "in claim 1," to --in claims 1 or 3,--.

Signed and Sealed this

Sixth Day of May, 1997

Bruce Lehman

*Attest:*

BRUCE LEHMAN

*Attesting Officer*

*Commissioner of Patents and Trademarks*